US011086242B2

(12) United States Patent
Isono et al.

(10) Patent No.: US 11,086,242 B2
(45) Date of Patent: Aug. 10, 2021

(54) TONER AND METHOD FOR PRODUCING TONER

(71) Applicant: CANON KABUSHIKI KAISHA, Tokyo (JP)

(72) Inventors: Naoya Isono, Suntou-gun (JP); Keiichiro Tsubaki, Numazu (JP); Yasuaki Murai, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/662,130

(22) Filed: Oct. 24, 2019

(65) Prior Publication Data

US 2020/0133151 A1 Apr. 30, 2020

(30) Foreign Application Priority Data

Oct. 30, 2018 (JP) ..... JP2018-204456

(51) Int. Cl.
*G03G 9/087* (2006.01)
*G03G 9/08* (2006.01)

(52) U.S. Cl.
CPC ..... *G03G 9/08711* (2013.01); *G03G 9/0806* (2013.01); *G03G 9/0874* (2013.01); *G03G 9/08793* (2013.01)

(58) Field of Classification Search
CPC ..... G03G 9/08711; G03G 9/0806; G03G 9/08793
See application file for complete search history.

(56) References Cited

U.S. PATENT DOCUMENTS 4,966,829 A * 10/1990 Yasuda ..... G03G 9/08786 430/109.3
6,017,670 A * 1/2000 Hashizume ..... G03G 9/0819 430/108.11
7,141,342 B2 11/2006 Toyoda et al.
7,288,357 B2 10/2007 Toyoda et al.
7,833,685 B2 11/2010 Tanaka et al.
8,211,606 B2 7/2012 Murai et al.
8,367,289 B2 2/2013 Isono et al.
8,377,616 B2 2/2013 Tani et al.
8,440,382 B2 5/2013 Isono et al.
8,497,054 B2 7/2013 Sugiyama et al.
8,628,899 B2 1/2014 Kawamura et al.
8,652,737 B2 2/2014 Handa et al.
8,778,581 B2 7/2014 Nonaka et al.
8,815,484 B2 8/2014 Tanaka et al.
9,158,216 B2 10/2015 Shinano et al.
9,377,705 B2 6/2016 Shimano et al.
9,383,668 B2 7/2016 Noji et al.
9,500,972 B2 11/2016 Tanaka et al.
9,556,290 B2 1/2017 Nishiura et al.
9,575,424 B2 2/2017 Nakagawa et al.
9,599,919 B2 3/2017 Isono et al.
9,658,549 B2 5/2017 Tanaka et al.
9,715,187 B2 7/2017 Mukumoto et al.
9,785,071 B2 10/2017 Shimano et al.
9,829,814 B2 11/2017 Yoshida et al.
9,829,816 B2 11/2017 Tanaka et al.
9,835,964 B2 12/2017 Yoshida et al.
9,904,193 B2 2/2018 Nakagawa et al.
9,958,801 B2 5/2018 Tanaka et al.
10,078,279 B2 9/2018 Nakagawa et al.
10,101,681 B2 10/2018 Tagawa et al.
10,216,107 B2 2/2019 Tsubaki et al.
2005/0069799 A1* 3/2005 Toman ..... G03G 9/08795 430/108.4
2005/0209364 A1 9/2005 Yamagishi et al.
2010/0143835 A1* 6/2010 Shin ..... G03G 15/0877 430/110.3
2010/0297547 A1* 11/2010 Hirota ..... C08L 67/00 430/109.4
2011/0136053 A1* 6/2011 Akers, Jr. ..... C08G 83/005 430/108.4
2014/0356779 A1 12/2014 Hasegawa et al.
2014/0377697 A1 12/2014 Nishiura et al.

FOREIGN PATENT DOCUMENTS

JP H07-219272 8/1995
JP 2009249561 A * 10/2009

OTHER PUBLICATIONS

English language machine translation of JP 2009-249561. (Year: 2009).*
U.S. Appl. No. 16/662,123, Keiichiro Tsubaki, filed Oct. 24, 2019.

* cited by examiner

*Primary Examiner* — Christopher D Rodee
(74) *Attorney, Agent, or Firm* — Venable LLP

(57) ABSTRACT

The toner has a toner particle that contains a binder resin, wherein the binder resin contains a styrene-acrylic resin that has a structure derived from a crosslinking agent, the binder resin includes tetrahydrofuran-insoluble matter in an amount of from 5 mass % to 60 mass % of the binder resin, and the crosslinking agent contains a polymeric compound provided by an addition reaction at least between a particular multi-functional (meth)acrylate compound and a particular polyvalent mercapto compound.

6 Claims, No Drawings

TONER AND METHOD FOR PRODUCING TONER

BACKGROUND OF THE INVENTION

Field of the Invention

The present invention relates to a toner and a method for producing a toner used to form a toner image by the development of the electrostatic latent image formed by a method such as an electrophotographic method, electrostatic recording method, or toner jet system recording method.

Description of the Related Art

An image-forming method that proceeds via the development of an electrostatic latent image is used in copiers, multifunction machines, and printers. Generally in this image-forming method, an electrostatic latent image is formed on a photosensitive member, a toner image is then formed by the development of this electrostatic latent image using toner, this toner image is transferred to a transfer material, e.g., paper, and a fixed image is subsequently obtained by fixing the toner image to the transfer material by a fixing method that employs the application of heat and pressure.

Various methods have been developed for the process of fixing the toner image to the transfer material. Examples here are the heated roller fixing method, in which the toner image is fixed to the transfer material using a heated roller and a pressure roller, and the film fixing method, in which the toner image is fixed to the transfer material by close contact between a pressure member and a heater with a film interposed therebetween.

Because the toner image on the transfer material is in contact with the surface of the film or heated roller in these fixing methods, they exhibit an excellent thermal efficiency during melt adhesion of the toner image onto the transfer material and thus can carry out fixing very rapidly. These fixing methods are widely deployed in multifunction machines and printers as a consequence.

However, in these fixing methods, because contact is effected in the molten state between the toner and the surface of the fixing member, e.g., the film or heated roller, an offset phenomenon can be produced in which some of the toner ends up sticking to the surface of the fixing member and the toner attached to the film or heated roller is then ultimately retransferred to the fixing material. To respond to this problem, offset is generally suppressed by controlling the viscoelasticity of the toner through the formation of a high-molecular-weight component (also referred to as a gel) achieved by the crosslinking of all or a portion of the binder resin in the toner. This method results in a substantial improvement in the offset property of the toner.

However, high-gloss images have come to be required at the present time due to the advance of full color capabilities in copiers and printers, and, since the high-molecular-weight component (gel) formed by crosslinking does influence the gloss in the methods referenced above, it has been a problem to satisfy both the offset property and a high gloss appearance at the same time.

To respond to this problem, for example, the use of a microgel in the toner is proposed in Japanese Patent Application Laid-open No. H07-219272. This method achieved coexistence between the offset property and high gloss and provided a high-performing toner.

SUMMARY OF THE INVENTION

However, the higher speeds of multifunction machines and printers in recent years have also been accompanied by demands for higher levels of toner performance. The coexistence between the offset property and high gloss provided even by the aforementioned method has also become unsatisfactory, and further improvement is required.

In addition, toner that enables printing on a long-term basis has come to be required due to increases in the service life of copiers and printers. There is little interaction at the interface between the binder resin and microgel in the toner provided by the aforementioned method, and it has been found that during long-term printing a satisfactory durability is not obtained and melt adhesion to the developing device is produced, resulting in the occurrence of image defects.

An object of the present invention is to provide a toner that exhibits an excellent offset property while also maintaining a high gloss and that enables the formation of an excellent toner image on a long-term basis.

The toner comprises a toner particle that contains a binder resin, wherein the binder resin contains a styrene-acrylic resin that has a structure derived from a crosslinking agent, the binder resin includes tetrahydrofuran-insoluble matter in an amount of from 5 mass % to 60 mass % of the binder resin, and the crosslinking agent contains a polymeric compound provided by an addition reaction at least between a compound represented by formula (1) and a compound represented by formula (2).

(1)

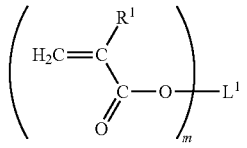

(2)

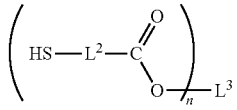

In formula (1), $R^1$ represents a hydrogen atom or an alkyl group having 1 to 4 carbon atoms; $L^1$ represents an m-valent linear or branched aliphatic hydrocarbon group optionally having a hydroxy group, or an ether bond-containing m-valent linear or branched aliphatic hydrocarbon group optionally having a hydroxy group; and m is an integer from 3 to 6.

In formula (2), $L^2$ represents an alkylene group; $L^3$ represents an n-valent linear or branched aliphatic hydrocarbon group optionally having a hydroxy group, or an ether bond-containing n-valent linear or branched aliphatic hydrocarbon group optionally having a hydroxy group; and n is an integer from 3 to 6.

The present invention thus provides a toner that exhibits an excellent offset property while also maintaining a high gloss and that has an excellent long-term developing performance.

Further features of the present invention will become apparent from the following description of exemplary embodiments.

DESCRIPTION OF THE EMBODIMENTS

Unless specifically indicated otherwise, expressions such as "from XX to YY" and "XX to YY" that show numerical value ranges refer in the present invention to numerical value ranges that include the lower limit and upper limit that are the end points.

Embodiments of the present invention are specifically described in the following.

The toner according to the present invention is a toner comprising a toner particle that contains a binder resin, wherein the binder resin contains a styrene-acrylic resin that has a structure derived from a crosslinking agent, the binder resin includes tetrahydrofuran-insoluble matter in an amount of from 5 mass % to 60 mass % of the binder resin, and the crosslinking agent contains a polymeric compound provided by an addition reaction at least between a compound represented by formula (1) and a compound represented by formula (2).

(1)

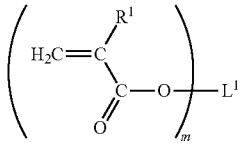

(2)

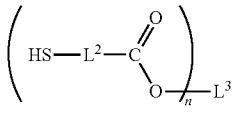

In formula (1), $R^1$ represents a hydrogen atom or an alkyl group having 1 to 4 carbon atoms; $L^1$ represents an m-valent linear or branched aliphatic hydrocarbon group optionally having a hydroxy group, or an ether bond-containing m-valent linear or branched aliphatic hydrocarbon group optionally having a hydroxy group; and m is an integer from 3 to 6.

In formula (2), $L^2$ represents an alkylene group; $L^3$ represents an n-valent linear or branched aliphatic hydrocarbon group optionally having a hydroxy group, or an ether bond-containing n-valent linear or branched aliphatic hydrocarbon group optionally having a hydroxy group; and n is an integer from 3 to 6.

The present inventors discovered that, by incorporating a styrene-acrylic resin having a structure derived from a crosslinking agent with the structural formulas given above and by having the proportion of tetrahydrofuran-insoluble matter in the binder resin be from 5 mass % to 60 mass % of the binder resin, a toner is obtained that exhibits an excellent offset property and also an excellent developing performance while also maintaining a high gloss.

The wordings "a structure derived from a crosslinking agent" denotes a structure cross-linked by a crosslinking agent.

Specifically, in the present invention a polymeric compound obtained by the Michael addition of a polyvalent mercapto compound with formula (2) to a multifunctional (meth)acrylate compound with formula (1) is used as a crosslinking agent and this is copolymerized with polymerizable monomer that forms a styrene-acrylic resin. Because this polymeric compound has the (meth)acryloyl group in a high density state in the molecule, a microgel is formed due to the crosslinking reaction between the polymerizable monomer and this polymeric compound that proceeds locally at the periphery where this polymeric compound is present in the system.

This microgel has less ability than a conventional gel to influence the mirror surface of the image at the time of fixing and a high gloss image is obtained as a result. The offset property is also excellent due to the ability to also satisfactorily introduce the gel component required to control the viscoelasticity of the toner. In addition, the gel component formed by crosslinking, because it has the same composition as the resin of the uncrosslinked portion, has a satisfactory interaction, e.g., intermolecular entanglement and so forth, and the mechanical durability is excellent as a consequence and an excellent developing performance is obtained on a long-term basis.

$R^1$ in formula (1) preferably is a hydrogen atom or methyl group. $L^1$ preferably represents an m-valent linear or branched aliphatic hydrocarbon group having 5 to 10 carbon atoms and optionally having a hydroxy group, or represents an ether bond-containing m-valent linear or branched aliphatic hydrocarbon group having 5 to 10 carbon atoms and optionally having a hydroxy group. m is an integer from 3 to 6 (preferably 4 to 6).

$L^1$ is more preferably a pentaerythritol structure in which m is 3 or 4, that is, a group obtained by the elimination of 3 or 4 of the hydroxy groups from pentaerythritol, or a dipentaerythritol structure in which m is 5 or 6, that is, a group obtained by the elimination of 5 or 6 hydroxy groups from dipentaerythritol.

The multifunctional (meth)acrylate compound with formula (1) can be specifically exemplified by trimethylolpropane tri(meth)acrylate, ethylene oxide-modified trimethylolpropane tri(meth)acrylate, propylene oxide-modified trimethylolpropane tri(meth)acrylate, trimethylolethane tri(meth)acrylate, pentaerythritol tri(meth)acrylate, pentaerythritol tetra(meth)acrylate, dipentaerythritol penta(meth)acrylate, dipentaerythritol hexa(meth)acrylate, caprolactone-modified pentaerythritol tri(meth)acrylate, caprolactone-modified pentaerythritol tetra(meth)acrylate, and caprolactone-modified dipentaerythritol hexa(meth)acrylate. These compounds may be used alone or in combination of two or more.

At least one selected from the group consisting of pentaerythritol tri(meth)acrylate, pentaerythritol tetra(meth)acrylate, dipentaerythritol penta(meth)acrylate, and dipentaerythritol hexa(meth)acrylate is preferred.

In formula (2), $L^2$ preferably represents an alkylene group having 1 to 3 carbon atoms (more preferably methylene); $L^3$ represents an n-valent linear or branched aliphatic hydrocarbon group having 5 to 10 carbon atoms and optionally having a hydroxy group, or an ether bond-containing n-valent linear or branched aliphatic hydrocarbon group having 5 to 10 carbon atoms and optionally having a hydroxy group; and n is an integer from 3 to 6 (preferably 4 to 6).

$L^3$ is more preferably a pentaerythritol structure in which m is 4, that is, a group obtained by the elimination of the 4 hydroxy groups from pentaerythritol; or a dipentaerythritol structure in which m is 6, that is, a group obtained by the elimination of the 6 hydroxy groups from dipentaerythritol; or a trimethylolpropane structure in which m is 3, that is, a group obtained by the elimination of the 3 hydroxy groups from trimethylolpropane.

The polyvalent mercapto compound with formula (2) can be exemplified by trimethylolpropane tri(mercaptoacetate), trimethylolpropane tri(mercaptopropionate), pentaerythritol tetra(mercaptoacetate), pentaerythritol tri(mercaptoacetate), pentaerythritol tetra(mercaptopropionate), dipentaerythritol hexa(mercaptoacetate), and dipentaerythritol hexa(mercaptopropionate).

At least one selected from the group consisting of trimethylolpropane tri(mercaptoacetate), pentaerythritol tetra (mercaptoacetate), and dipentaerythritol hexa(mercaptoacetate) is preferred.

The amounts of use in the crosslinking agent of the compounds with formulas (1) and (2) should be selected as appropriate in conformity to the number of functional groups in each and is not particularly limited.

For example, the content in the crosslinking agent of the structure originating with the compound with formula (1) is preferably from 50 mass % to 95 mass %. The content in the crosslinking agent of the structure originating with the compound with formula (2) is preferably from 5 mass % to 50 mass %. The structure originating with the compound with formula (1) and the structure originating with the compound with formula (2) also includes, in addition to the structure provided by the addition reaction of the particular compound, the unreacted compound.

The proportion of tetrahydrofuran-insoluble matter in the binder resin in the present invention is from 5 mass % to 60 mass % of the binder resin. The effects of the present invention are obtained at from 5 mass % to 60 mass % because the amount of gel in the binder resin is then an optimal amount. The amount of the tetrahydrofuran-insoluble matter can be adjusted using the amount of crosslinking agent addition.

When the tetrahydrofuran-insoluble matter is less than 5 mass %, there is then an inadequate amount of gel to suppress offset and this effect is not obtained. At more than 60 mass %, the fixed image ends up being affected even though this is a microgel and a high gloss is not obtained. The proportion of the tetrahydrofuran-insoluble matter is preferably from 10 mass % to 40 mass %.

The total number of acryloyl groups and methacryloyl groups per one molecule of the crosslinking agent is preferably at least 10: this facilitates the occurrence of intramolecular crosslinking and facilitates microgel formation, and the generation of a high gloss is facilitated as a result. At least 20 is more preferred. While the upper limit, on the other hand, is not particularly limited, it is preferably not more than 200 and is more preferably not more than 150.

To the extent that the effects of the present invention are not impaired, another compound may be reacted in the addition reaction between the compound with formula (1) and the compound with formula (2). For example, a mercapto compound represented by the following formula (A) can be used with the goal of controlling the number of (meth)acryloyl groups. Thus, the polymeric compound provided by the addition reaction at least between the compound with formula (1) and the compound with formula (2) may be a polymeric compound provided by the addition reaction of a compound with formula (2) and a compound with formula (A) to a compound with formula (1).

$$HS—R^3 \quad (A)$$

(In the formula, $R^3$ is an alkyl group having 1 to 6 (preferably 1 to 4) carbon atoms.)

The amount of use of the compound with formula (A), per 100 mass parts of the compound with formula (1), is preferably 0.02 mass parts to 5 mass parts and is more preferably approximately 0.05 mass parts to 3 mass parts.

The weight-average molecular weight (Mw) of the crosslinking agent is preferably from 4000 to 50000 and is more preferably from 8000 to 30000. When this range is satisfied, the dispersibility in the polymerizable monomer is excellent and because of this the microgel that forms is also dispersed and the developing performance is excellent.

The polymeric compound provided by the addition reaction at least between the compound with formula (1) and the compound with formula (2) preferably has a dendritic structure such as a dendrimer or hyperbranched polymer. Thus, the polymeric compound is preferably a dendritic acrylate or a dendritic methacrylate. Intramolecular crosslinking precedes intermolecular crosslinking by having the dendritic structure be present, which facilitates production of a microgel.

A dendritic structure can be obtained by adjusting the addition reaction by controlling the ratio between the amounts of addition of the compound with formula (1) and the compound with formula (2) and controlling the timing of addition.

The crosslinking agent preferably also contains a compound represented by formula (3). By having the crosslinking agent contain the compound with formula (3), intermolecular crosslinking occurs to a suitable degree and the mechanical strength is increased and an improvement in the durability can be expected.

For example, the crosslinking agent can be obtained by adding the compound with formula (3) to the polymeric compound provided by the addition reaction between the compound with formula (1) and the compound with formula (2). Moreover, when, during the formation of the polymeric compound provided by the addition reaction between the compound with formula (1) and the compound with formula (2), the compound with formula (1) remains as an unreacted substance and this unreacted substance satisfies the conditions for formula (3), a crosslinking agent (crosslinking agent composition) can be obtained that contains the polymeric compound and the formula (3) compound that is this unreacted substance.

(3)

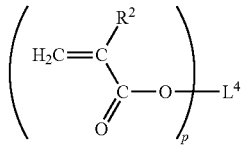

In formula (3), $R^2$ represents a hydrogen atom or an alkyl group having 1 to 4 carbon atoms; $L^4$ represents a p-valent linear or branched aliphatic hydrocarbon group optionally having a hydroxy group, or an ether bond-containing p-valent linear or branched aliphatic hydrocarbon group optionally having a hydroxy group; and p is an integer from 2 to 6.

$R^2$ in formula (3) preferably is a hydrogen atom or methyl group. Preferably $L^4$ represents a p-valent linear or branched aliphatic hydrocarbon group having 5 to 10 carbon atoms and optionally having a hydroxy group, or represents an ether bond-containing p-valent linear or branched aliphatic hydrocarbon group having 5 to 10 carbon atoms and optionally having a hydroxy group, and p is an integer from 3 to 6 (preferably 4 to 6).

The compound with formula (3) can be exemplified by ethylene glycol di(meth)acrylate, diethylene glycol di(meth) acrylate, triethylene glycol di(meth)acrylate, tetraethylene glycol di(meth)acrylate, tetramethylene glycol di(meth) acrylate, trimethylolpropane tri(meth)acrylate, trimethylolethane tri(meth)acrylate, pentaerythritol di(meth)acrylate, pentaerythritol tri(meth)acrylate, pentaerythritol tetra(meth) acrylate, dipentaerythritol penta(meth)acrylate, and dipentaerythritol hexa(meth)acrylate.

At least one selected from the group consisting of pentaerythritol tri(meth)acrylate, pentaerythritol tetra(meth) acrylate, dipentaerythritol penta(meth)acrylate, and dipentaerythritol hexa(meth)acrylate is preferred.

The content of the compound with formula (3) in the crosslinking agent is preferably from 10 mass % to 50 mass % and is more preferably from 15 mass % to 40 mass %.

The method for producing the toner particle is not particularly limited and a known production method can be employed, while methods in which a polymerizable monomer composition is granulated in an aqueous medium, such as the suspension polymerization method and emulsion polymerization method, are preferred. For example, a preferred toner production method has a step of obtaining the binder resin by the polymerization of a polymerizable monomer composition that contains a crosslinking agent and a polymerizable monomer that produces the binder resin.

A toner particle production method using a suspension polymerization method preferred for the present invention is described in the following.

A polymerizable monomer composition is prepared by effecting the uniform dissolution or dispersion, using a disperser such as a homogenizer, ball mill, colloid mill, or ultrasound disperser, of polymerizable monomer that will produce the binder resin, crosslinking agent, and other, optional additives such as a wax and a colorant, and dissolving therein a polymerization initiator. The toner particle is then produced by suspending this polymerizable monomer composition in an aqueous medium that contains a dispersion stabilizer and carrying out polymerization.

Thus, a preferred production method has a step of dispersing and granulating, in an aqueous medium, a polymerizable monomer composition comprising the crosslinking agent and polymerizable monomer that will produce the binder resin, to form particles of the polymerizable monomer composition; and a step of obtaining toner particles by copolymerizing the polymerizable monomer and a crosslinking agent contained in the particles of the polymerizable monomer composition.

The amount of use of the crosslinking agent, per 100 mass parts of the polymerizable monomer, is preferably 0.5 mass parts to 5.0 mass parts and is more preferably 1.0 mass parts to 3.0 mass parts.

The polymerization initiator may be added at the same time as the addition of the other additives to the polymerizable monomer or may be admixed immediately before suspension in the aqueous medium. The polymerization initiator dissolved in the polymerizable monomer or solvent may also be added immediately after granulation and before the start of the polymerization reaction.

The binder resin contains a styrene-acrylic resin that has a structure derived from the crosslinking agent.

The following monomers, for example, may be used for the styrene-acrylic resin:

styrenic monomers, e.g., styrene and derivatives thereof, such as styrene, o-methyl styrene, m-methyl styrene, p-methyl styrene, p-methoxystyrene, p-phenyl styrene, p-chlorostyrene, 3,4-dichlorostyrene, p-ethyl styrene, 2,4-dimethyl styrene, p-n-butylstyrene, p-tert-butyl styrene, p-n-hexyl styrene, p-n-octylstyrene, p-n-nonylstyrene, p-n-decylstyrene, and p-n-dodecylstyrene;

acrylate esters, e.g., methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate; and methacrylate esters, e.g., esters of a-methylene aliphatic monocarboxylic acid, such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate.

Preferred among the preceding are polymers from styrene and at least one selection from the group consisting of acrylate esters and methacrylate esters. Thus, preferably the binder resin contains a copolymer of the crosslinking agent, styrene, and at least one selection from the group consisting of acrylate esters and methacrylate esters.

The following organic pigments, organic dyes, and inorganic pigments may be used as a colorant in the toner particle.

Cyan colorants can be exemplified by copper phthalocyanine compounds and derivatives thereof, anthraquinone compounds, and basic dye lake compounds. The following are specific examples:

C. I. Pigment Blue 1, 7, 15, 15:1, 15:2, 15:3, 15:4, 60, 62, and 66.

The following are examples of magenta colorants: condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. The following are specific examples:

C. I. Pigment Red 2, 3, 5, 6, 7, 23, 48:2, 48:3, 48:4, 57:1, 81:1, 122, 144, 146, 150, 166, 169, 177, 184, 185, 202, 206, 220, 221, and 254, and C. I. Pigment Violet 19.

Yellow colorants can be exemplified by condensed azo compounds, isoindolinone compounds, anthraquinone compounds, azo-metal complexes, methine compounds, and allylamide compounds. The following are specific examples:

C. I. Pigment Yellow 12, 13, 14, 15, 17, 62, 74, 83, 93, 94, 95, 97, 109, 110, 111, 120, 127, 128, 129, 147, 151, 154, 155, 168, 174, 175, 176, 180, 181, 185, 191, and 194.

Black colorants can be exemplified by carbon black and by black colorants provided by color mixing using the aforementioned yellow colorants, magenta colorants, and cyan colorants to give a black color.

These colorants may be used alone or as a mixture, and these colorants may also be used in a solid solution state. The colorant is selected considering the hue angle, chroma, lightness, lightfastness, OHP transparency, and dispersibility in the toner particle.

The colorant is preferably used at from 1.0 mass parts to 20.0 mass parts per 100.0 mass parts of the binder resin.

When the toner particle is obtained using the suspension polymerization method, the use is preferred, considering the polymerization-inhibiting activity and aqueous phase transferability possessed by colorants, of a colorant on which a hydrophobic treatment has been executed using a substance that does not inhibit polymerization. In an example of a preferred method for executing a hydrophobic treatment on a dye, a colored polymer is preliminarily prepared by polymerizing the polymerizable monomer in the presence of the dye and the resulting colored polymer is added to the polymerizable monomer composition.

In the case of carbon black, in addition to a hydrophobic treatment as described above for a dye, a treatment may be carried out with a substance (polyorganosiloxane) that reacts with the surface functional groups on carbon black.

A charge control agent may be used on an optional basis. A known charge control agent can be used as the charge control agent, wherein a charge control agent that provides a fast triboelectric charging speed and that can maintain a defined and stable triboelectric charge quantity is particularly preferred. When the toner particle is produced by the suspension polymerization method, a charge control agent that exercises little polymerization inhibition and that is substantially free of material soluble in the aqueous medium is particularly preferred.

The charge control agents include those that control the toner to negative charging and those that control the toner to positive charging. Charge control agents that control the toner to negative charging can be exemplified by monoazo metal compounds; acetylacetone-metal compounds; metal compounds of aromatic oxycarboxylic acids, aromatic dicarboxylic acids, oxycarboxylic acids, and dicarboxylic acids; aromatic oxycarboxylic acids, aromatic monocarboxylic acids, and aromatic polycarboxylic acids and their metal salts, anhydrides, and esters; phenol derivatives such as bisphenol; urea derivatives; metal-containing salicylic acid compounds; metal-containing naphthoic acid compounds; boron compounds; quaternary ammonium salts; calixarene; and charge control resins.

Charge control agents that control the toner to positive charging, on the other hand, can be exemplified by the following: guanidine compounds; imidazole compounds; quaternary ammonium salts such as tributylbenzylammonium 1-hydroxy-4-naphthosulfonate and tetrabutylammonium tetrafluoroborate, and their onium salt analogues, such as phosphonium salts, and their lake pigments; triphenylmethane dyes and their lake pigments (the laking agent is exemplified by phosphotungstic acid, phosphomolybdic acid, phosphomolybdotungstic acid, tannic acid, lauric acid, gallic acid, ferricyanides, and ferrocyanides); metal salts of higher fatty acids; and charge control resins.

These charge control agents may be added alone or in combination of two or more.

Among these charge control agents, metal-containing salicylic acid compounds are preferred and metal-containing salicylic acid compounds in which the metal is aluminum or zirconium are particularly preferred.

The amount of addition of the charge control agent, per 100.0 mass parts of the binder resin, is preferably from 0.01 mass parts to 20.0 mass parts and is more preferably from 0.5 mass parts to 10.0 mass parts.

A polymer or copolymer having a sulfonic acid group, sulfonate salt group, or sulfonate ester group is preferably used for the charge control resin. The polymer having a sulfonic acid group, sulfonate salt group, or sulfonate ester group particularly preferably contains at least 2 mass %, as the copolymerization ratio, of a sulfonic acid group-containing acrylamide-type monomer or sulfonic acid group-containing methacrylamide-type monomer, and more preferably contains at least 5 mass % of same.

The charge control resin preferably has a glass transition temperature (Tg) from 35° C. to 90° C., a peak molecular weight (Mp) from 10000 to 30000, and a weight-average molecular weight (Mw) from 25000 to 50000. When this is used, preferred triboelectric charging characteristics can be conferred without exercising an influence on the thermal characteristics required of the toner particle. Moreover, because the charge control resin contains a sulfonic acid group, for example, the dispersibility of the charge control resin itself in the colorant dispersion and the dispersibility of the colorant are improved and the tinting strength, transparency, and triboelectric charging characteristics can then be further improved.

A polymerization initiator may be used in order to polymerize the polymerizable monomer. The polymerization initiator can be exemplified by organoperoxide-type initiators and azo-type initiators. The organoperoxide-type initiators can be exemplified by the following:

benzoyl peroxide, lauroyl peroxide, di-α-cumyl peroxide, 2,5-dimethyl-2,5-bis(benzoylperoxy)hexane, bis(4-t-butylcyclohexyl) peroxydicarbonate, 1,1-bis(t-butylperoxy)cyclododecane, t-butyl peroxymaleate, bis(t-butylperoxy) isophthalate, methyl ethyl ketone peroxide, tert-butyl peroxy-2-ethylhexanoate, diisopropyl peroxycarbonate, cumene hydroperoxide, 2,4-dichlorobenzoyl peroxide, and tert-butyl peroxypivalate.

The azo-type polymerization initiators are exemplified by 2,2'-azobis(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobismethylbutyronitrile.

A redox initiator, comprising the combination of an oxidizing substance with a reducing substance, may also be used as the polymerization initiator. The oxidizing substance can be exemplified by inorganic peroxides such as hydrogen peroxide and persulfate salts (sodium salt, potassium salt, and ammonium salt) and by oxidizing metal salts such as tetravalent cerium salts.

The reducing substance can be exemplified by reducing metal salts (divalent iron salts, monovalent copper salts, and trivalent chromium salts); ammonia; amino compounds such as lower amines (amines having from 1 to about 6 carbon atoms, such as methylamine and ethylamine) and hydroxylamine; reducing sulfur compounds such as sodium thiosulfate, sodium hydrosulfite, sodium bisulfite, sodium sulfite, and sodium formaldehyde sulfoxylate; lower alcohols (from 1 to 6 carbon atoms); ascorbic acid and its salts; and lower aldehydes (from 1 to 6 carbon atoms).

The polymerization initiator is selected considering its 10-hour half-life temperature, and may be used alone or as a mixture. The amount of addition of the polymerization initiator will vary with the desired degree of polymerization, but generally from 0.5 mass parts to 20.0 mass parts is added per 100.0 mass parts of the polymerizable monomer.

A known chain transfer agent and polymerization inhibitor may also be added and used in order to control the degree of polymerization.

The known inorganic compound dispersion stabilizers and organic compound dispersion stabilizers can be used as the dispersion stabilizer used in the preparation of the aqueous medium. The inorganic compound dispersion stabilizers can be exemplified by tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, and alumina.

The following, on the other hand, are examples of organic compound dispersion stabilizers: polyvinyl alcohol, gelatin, methyl cellulose, methyl hydroxypropyl cellulose, ethyl cellulose, the sodium salt of carboxymethyl cellulose, polyacrylic acid and salts thereof, and starch. These dispersion stabilizers are preferably used in an amount from 0.2 mass parts to 20.0 mass parts per 100.0 mass parts of the polymerizable monomer.

When, among these dispersion stabilizers, an inorganic compound dispersion stabilizer is used, a commercially available inorganic compound dispersion stabilizer may be directly used as such; however, the inorganic compound may be produced in the aqueous medium in order to obtain a dispersion stabilizer having an even finer particle diameter. For example, in the case of tricalcium phosphate, it may be obtained by mixing an aqueous sodium phosphate solution with an aqueous calcium chloride solution under high speed stirring.

The toner particle may be used as such as a toner, or an external additive may be externally added to the toner particle in order to impart various properties to the toner. External additives for bringing about an enhanced toner flowability can be exemplified by inorganic fine particles such as silica fine particles, titanium oxide fine particles, and composite oxide fine particles thereof. Silica fine particles and titanium oxide fine particles are preferred among inorganic fine particles.

For example, a toner may be obtained by externally adding inorganic fine particles to the toner particle and mixing in order to attach the inorganic fine particles to the toner particle surface. A known method may be adopted for the method of carrying out the external addition of the inorganic fine particles. For example, a mixing process may be carried out using a Henschel mixer (Mitsui Miike Chemical Engineering Machinery Co., Ltd.).

The silica fine particles can be exemplified by the dry silica and fumed silica produced by the vapor-phase oxidation of a silicon halide, and by the wet silica produced from water glass. Dry silica is preferred for the inorganic fine particles because dry silica contains little of the silanol group present on the surface and in the interior of silica fine particles and contains little $Na_2O$ and $SO_3^{2-}$. The dry silica may be a composite fine particle of silica and another metal oxide as obtained by the use in the production process of a silicon halide compound in combination with another metal halide compound such as, for example, aluminum chloride or titanium chloride.

Adjustment of the triboelectric charge quantity on the toner, an improved environmental stability, and an enhanced flowability in a high-temperature, high-humidity environment can be achieved through a hydrophobic treatment of the surface of the inorganic fine particles with a treatment agent, and the use of hydrophobically treated inorganic fine particles is thus preferred. When the inorganic fine particles that have been externally added to the toner are hygroscopic, the triboelectric charge quantity and flowability of the toner are reduced, facilitating reductions in the developing performance and transferability.

The treatment agent for hydrophobically treating the inorganic fine particles can be exemplified by unmodified silicone varnishes, variously modified silicone varnishes, unmodified silicone oils, variously modified silicone oils, silane compounds, silane coupling agents, other organosilicon compounds, and organotitanium compounds. Silicone oils are preferred among the preceding. These treatment agents may be used alone or in combination.

The total amount of inorganic fine particle addition, per 100.0 mass parts of the toner particle, is preferably from 1.0 mass parts to 5.0 mass parts and is more preferably from 1.0 mass parts to 2.5 mass parts. Viewed from the standpoint of durability when added to the toner, the external additive preferably has a particle diameter that is not more than one-tenth of the average particle diameter of the toner particle.

The methods used to measure the various properties pertaining to the present invention are described in the following.

Measurement of Weight-Average Molecular Weight (Mw) of Crosslinking Agent

The weight-average molecular weight (Mw) of the crosslinking agent is measured using gel permeation chromatography (GPC) as follows.

First, the crosslinking agent is dissolved in tetrahydrofuran at room temperature for 24 hours. The obtained solution is filtered using a "Sample Pretreatment Cartridge" (Tosoh Corporation) solvent-resistant membrane filter having a pore diameter of 0.2 μm to obtain a sample solution. The sample solution is adjusted to a concentration of THF-soluble component of approximately 0.8 mass %. Measurement is carried out under the following conditions using this sample solution.

instrument: HLC8120 GPC (detector: RI) (Tosoh Corporation)

column: 7-column train of Shodex KF-801, 802, 803, 804, 805, 806, and 807 (Showa Denko Kabushiki Kaisha)

eluent: tetrahydrofuran (THF)

flow rate: 1.0 mL/min oven temperature: 40.0° C.

sample injection amount: 0.10 mL

A molecular weight calibration curve constructed using polystyrene resin standards (for example, product name "TSK Standard Polystyrene F-850, F-450, F-288, F-128, F-80, F-40, F-20, F-10, F-4, F-2, F-1, A-5000, A-2500, A-1000, A-500", Tosoh Corporation) is used to determine the molecular weight of the sample.

Calculation of Number of (Meth)acryloyl Groups

The total number of acryloyl groups and methacryloyl groups per 1 molecule of the crosslinking agent is calculated from the weight-average molecular weight (Mw) provided by gel permeation chromatography (GPC) and a determination of the (meth)acryloyl group by the internal reference method using nuclear magnetic resonance spectroscopic analysis ($^1$H-NMR).

A known reagent is used for the (meth)acryloyl group reference sample; a calibration curve is constructed of the concentration ratio with the internal reference substance-versus-the integration value ratio; and, using the calibration curve, the (meth)acryloyl group is determined from NMR measurement of the crosslinking agent added in the internal reference method.

measurement instrument: JNM-EX400 FT-NMR instrument (JEOL Ltd.)

measurement frequency: 400 MHz pulse condition: 5.0 μs frequency range: 10,500 Hz number of scans: 64 times measurement solvent: $CDCl_3$ The number of (meth)acryloyl groups per 1 molecule in the present invention was the value calculated with the following formula using the value provided by the aforementioned determination and the weight-average molecular weight (Mw) given by GPC.

number ($N$) of (meth)acryloyl groups per 1 molecule=molality of (meth)acryloyl groups (mol/kg) according to the NMR determination× weight-average molecular weight (Mw)/1000

Amount of Tetrahydrofuran-Insoluble Matter

The THF-insoluble matter in the resin component in the toner is measured proceeding as follows.

Approximately 1.0 g of the binder resin is weighed (W1 g) and is introduced into a pre-weighed extraction thimble (for example, product name: No. 86R (size 28×100 mm), Advantec Toyo Kaisha, Ltd.), and this is set into a Soxhlet extractor. Extraction is carried out for 16 hours using 200 mL of tetrahydrofuran as solvent. During this process, the extraction is run at a reflux rate that provides an extraction solvent cycle of once in approximately 5 minutes.

After the completion of the extraction, the thimble is removed and is air dried, followed by vacuum drying for 8 hours at 40° C. and weighing the mass of the thimble containing the extraction residue, and the mass of the thimble is subtracted to determine the mass of the extraction residue (W2 g).

The THF-insoluble matter can be determined by subtracting, as in the following formula, the content (W3 g) of the components other than the resin component.

$$\text{THF-insoluble matter (mass \%)}=\{(W2-W3)/(W1-W3)\}\times 100$$

The content of the components other than the resin component can be measured using known analytic procedures.

EXAMPLES

The present invention is more specifically described in the following using examples. The present invention is not limited by the examples that follow. The number of parts in the examples and comparative examples is on a mass basis in all instances unless specifically indicated otherwise.

Production of Crosslinking Agent 1

230 g of propylene glycol monomethyl ether, 20 g of pentaerythritol tetra(mercaptoacetate), 220 g of a mixture of dipentaerythritol hexaacrylate and dipentaerythritol pentaacrylate (M-402, Toagosei Co., Ltd.), 0.1 g of hydroquinone, and 0.01 g of benzyldimethylamine were added to a 1-L four-neck flask, and a reaction was run for 12 hours at 60° C. to give crosslinking agent 1.

Analysis of crosslinking agent 1 gave the following: number of acryloyl groups per 1 molecule=100, mixture of unreacted dipentaerythritol hexaacrylate and dipentaerythritol pentaacrylate=30 mass %.

Production of Crosslinking Agents 2 to 8

Crosslinking agents 2 to 8 were obtained using the same production method as for crosslinking agent 1, but changing the starting materials and number of parts of addition as shown in Table 1.

The multifunctional (meth)acrylate compound used for crosslinking agent 3 is a mixture of dipentaerythritol hexaacrylate and dipentaerythritol pentaacrylate (M-400, Toagosei Co., Ltd.).

The multifunctional (meth)acrylate compound used for crosslinking agent 4 is a mixture of pentaerythritol tetraacrylate and pentaerythritol triacrylate (M-305, Toagosei Co., Ltd.).

The crosslinking agent 8 was purified by dialysis using a semipermeable membrane having a molecular weight cut off of 3,500.

Crosslinking agents 1 to 8 had dendritic structures.

TABLE 1

| | compound with formula (1) | | compound with formula (2) | | mercapto compound (for adjustment of number of (meth)acryloyl groups) | | Mw | number of (meth)acryloyl groups per 1 molecule | amount of compound with formula (3) (mass %) |
|---|---|---|---|---|---|---|---|---|---|
| crosslinking agent 1 | dipentaerythritol hexaacrylate/ dipentaerythritol pentaacrylate | 220 g | pentaerythritol tetra(mercaptoacetate) | 20 g | — | — | 12000 | 100 | 30 |
| crosslinking agent 2 | pentaerythritol tetraacrylate | 180 g | trimethylolpropane tri(mercaptoacetate) | 25 g | — | — | 4500 | 20 | 10 |
| crosslinking agent 3 | dipentaerythritol hexaacrylate/ dipentaerythritol pentaacrylate | 250 g | pentaerythritol tetra(mercaptoacetate) | 40 g | sec-butyl mercaptan | 2 g | 45000 | 120 | 20 |
| crosslinking agent 4 | pentaerythritol tetraacrylate pentaerythritol triacrylate | 160 g | trimethylolpropane tri(mercaptoacetate) | 25 g | — | — | 3500 | 15 | 10 |
| crosslinking agent 5 | dipentaerythritol hexaacrylate | 250 g | dipentaerythritol hexa(mercaptoacetate) | 30 g | sec-butyl mercaptan | 5 g | 55000 | 140 | 40 |
| crosslinking agent 6 | pentaerythritol tetraacrylate | 180 g | trimethylolpropane tri(mercaptoacetate) | 25 g | sec-butyl mercaptan | 0.3 g | 4600 | 12 | 10 |
| crosslinking agent 7 | pentaerythritol tetraacrylate | 180 g | trimethylolpropane tri(mercaptoacetate) | 25 g | sec-butyl mercaptan | 0.5 g | 4700 | 9 | 10 |
| crosslinking agent 8 | pentaerythritol tetraacrylate | 180 g | trimethylolpropane tri(mercaptoacetate) | 25 g | — | — | 4600 | 18 | purified (detection limit) |

Crosslinking Agents 9 to 11

The commercial crosslinking agents given in Table 2 were used for crosslinking agents 9 to 11.

TABLE 2

| | | |
|---|---|---|
| crosslinking agent 9 | 1,6-hexanediol diacrylate | Tokyo Chemical Industry Co., Ltd. |
| crosslinking agent 10 | pentaerythritol tetraacrylate | Shin-Nakamura Chemical Co., Ltd. |
| crosslinking agent 11 | dipentaerythritol hexaacrylate | Shin-Nakamura Chemical Co., Ltd. |

Toner 1 Production

An aqueous medium was prepared by adding 9.0 parts of tricalcium phosphate to 1300.0 parts of deionized water heated to a temperature of 60° C. and stirring at a stirring rate of 15,000 rpm using a T. K. Homomixer (Tokushu Kika Kogyo Co., Ltd.).

In addition, a mixture was prepared by mixing the following binder resin starting materials while stirring at a stirring rate of 100 rpm using a propeller-type stirrer.

| | |
|---|---|
| styrene | 75.0 parts |
| n-butyl acrylate | 25.0 parts |
| crosslinking agent 1 | 1.5 parts |
| The following were then added to the resulting solution. | |
| cyan colorant (C. I. Pigment Blue 15:3) | 6.5 parts |
| negative charge control agent (Bontron E-84, Orient Chemical Industries Co., Ltd.) | 0.5 parts |
| hydrocarbon wax (Tm = 78° C.) | 10.0 parts |

The mixture was then heated to a temperature of 65° C. and a polymerizable monomer composition was subsequently prepared by dissolving and dispersing with stirring at a stirring rate of 10,000 rpm using a T. K. Homomixer (Tokushu Kika Kogyo Co., Ltd.).

The polymerizable monomer composition was then introduced into the aforementioned aqueous medium;

| | |
|---|---|
| Perbutyl PV (10-hour half-life temperature = 54.6° C. (NOF Corporation)) | 10.0 parts |

was added as polymerization initiator; and granulation was performed by stirring at a temperature of 70° C. for 20 minutes at a stirring rate of 15,000 rpm using a T. K. Homomixer.

The stirrer was changed over to a propeller-type stirrer and, while stirring at a stirring rate of 200 rpm, a polymerization reaction was run on the styrene and n-butyl acrylate, which were the polymerizable monomers in the polymerizable monomer composition, for 5 hours at a temperature of 85° C. to produce a toner particle-containing slurry. The slurry was cooled when the polymerization reaction was finished. Hydrochloric acid was added to the cooled slurry to bring the pH to 1.4 and the calcium phosphate salt was dissolved by stirring for 1 hour. The slurry was then washed with 10-fold water and filtered and dried, and the particle diameter was subsequently adjusted by classification to obtain a toner particle.

1.5 parts of hydrophobic silica fine particles (primary particle diameter: 7 nm, BET specific surface area: 130 $m^2/g$), which had been treated with dimethyl silicone oil at 20 mass % with reference to the silica fine particles, was mixed as external additive with 100.0 parts of the aforementioned toner particle for 15 minutes at a stirring rate of 3,000 rpm using a Mitsui Henschel mixer (Mitsui Miike Chemical Engineering Machinery Co., Ltd.) to obtain a toner. The properties of the obtained toner 1 are given in Table 3.

Production of Toners 2 to 15

Toners 2 to 15 were obtained by the same production method as for toner 1, but changing the starting materials, number of parts of addition, and production conditions as shown in Table 3. The properties of the obtained toners are shown in Table 3.

Toner 16 Production

An aqueous medium was prepared by adding 9.0 parts of tricalcium phosphate to 1300.0 parts of deionized water heated to a temperature of 60° C. and stirring at a stirring rate of 15,000 rpm using a T. K. Homomixer (Tokushu Kika Kogyo Co., Ltd.).

In addition, a mixture was prepared by mixing the following binder resin starting materials while stirring at a stirring rate of 100 rpm using a propeller-type stirrer.

| | |
|---|---|
| styrene | 52.5 parts |
| n-butyl acrylate | 17.5 parts |
| styrene-type starburst dendrimer described in Japanese Patent Application Laid-open No. H07-219272 | 30.0 parts |
| The following were then added to the resulting solution. | |
| cyan colorant (C. I. Pigment Blue 15:3) | 6.5 parts |
| negative charge control agent (Bontron E-84, Orient Chemical Industries Co., Ltd.) | 0.5 parts |
| hydrocarbon wax (Tm = 78° C.) | 10.0 parts |

The mixture was then heated to a temperature of 65° C. and a polymerizable monomer composition was subsequently prepared by dissolving and dispersing with stirring at a stirring rate of 10,000 rpm using a T. K. Homomixer (Tokushu Kika Kogyo Co., Ltd.).

The polymerizable monomer composition was then introduced into the aforementioned aqueous medium;

| | |
|---|---|
| Perbutyl PV (10-hour half-life temperature = 54.6° C. (NOF Corporation)) | 7.0 parts |

was added as polymerization initiator; and granulation was performed by stirring at a temperature of 70° C. for 20 minutes at a stirring rate of 15,000 rpm using a T. K. Homomixer.

The stirrer was changed over to a propeller-type stirrer and, while stirring at a stirring rate of 200 rpm, a polymerization reaction was run on the styrene and n-butyl acrylate, which were the polymerizable monomers in the polymerizable monomer composition, for 5 hours at a temperature of 85° C. to produce a toner particle-containing slurry. The slurry was cooled when the polymerization reaction was finished. Hydrochloric acid was added to the cooled slurry to bring the pH to 1.4 and the calcium phosphate salt was dissolved by stirring for 1 hour. The slurry was then washed with 10-fold water and filtered and dried, and the particle diameter was then adjusted by classification to obtain a toner particle.

1.5 parts of hydrophobic silica fine particles (primary particle diameter: 7 nm, BET specific surface area: 130 $m^2/g$), which had been treated with dimethylsilicone oil at 20 mass % with reference to the silica fine particles, was mixed as external additive with 100.0 parts of the aforementioned toner particle for 15 minutes at a stirring rate of 3,000 rpm using a Mitsui Henschel mixer (Mitsui Miike Chemical Engineering Machinery Co., Ltd.) to obtain a toner 16.

TABLE 3

| | crosslinking agent | mass parts | amount of THF-insoluble matter (mass %) |
|---|---|---|---|
| toner 1 | crosslinking agent 1 | 1.5 | 40 |
| toner 2 | crosslinking agent 1 | 0.8 | 8 |
| toner 3 | crosslinking agent 1 | 2.0 | 60 |
| toner 4 | crosslinking agent 2 | 0.7 | 40 |
| toner 5 | crosslinking agent 3 | 1.7 | 40 |
| toner 6 | crosslinking agent 4 | 0.5 | 40 |
| toner 7 | crosslinking agent 5 | 1.8 | 40 |
| toner 8 | crosslinking agent 6 | 1.0 | 40 |
| toner 9 | crosslinking agent 7 | 1.2 | 40 |
| toner 10 | crosslinking agent 8 | 1.0 | 40 |
| toner 11 | crosslinking agent 9 | 0.5 | 40 |
| toner 12 | crosslinking agent 10 | 0.4 | 40 |
| toner 13 | crosslinking agent 11 | 0.4 | 40 |
| toner 14 | crosslinking agent 2 | 1.0 | 65 |
| toner 15 | crosslinking agent 2 | 0.2 | 3 |
| toner 16 | starburst dendrimer | 30.0 | — |

Image Evaluations

The image evaluations were performed using a partially modified commercial color laser printer [HP LaserJet Enterprise Color m553dn]. A modification has been made to enable the printer to operate even with only one color process cartridge. Another modification enabled the temperature at the fixing unit to be freely varied.

The toner in the black toner process cartridge installed in this color laser printer was removed; the interior was cleaned with an air blower; the particular toner (350 g) was introduced into the process cartridge; the toner-refilled process cartridge was installed in the color laser printer; and the following image evaluations were performed. The specific items in the image evaluation are as follows.

Gloss

A solid image (toner laid-on level: 0.6 $mg/cm^2$) was printed at a fixation temperature of 170° C., and the gloss value was measured using a PG-3D (Nippon Denshoku Industries Co., Ltd.). Letter-size plain paper (XEROX 4200 paper, Xerox Corporation, 75 $g/m^2$) was used as the transfer material.

Evaluation Criteria

A: the gloss value is equal to or greater than 30

B: the gloss value is less than 30 and equal to or greater than 20

C: the gloss value is less than 20 and equal to or greater than 15

D: the gloss value is less than 15

Offset Property

A halftone (toner laid-on level: 0.3 $mg/cm^2$) image was fixed on the transfer material at different fixation temperatures (190° C. to 220° C.), and the evaluation was performed based on the temperature at which offset was not produced. The fixation temperature is the value measured for the fixing roller surface using a noncontact thermometer. Plain paper (XEROX 4200 paper, letter size, 75 $g/m^2$, Xerox Corporation) was used for the transfer material.

A: offset does not occur at 210° C.

B: offset is produced at 210° C.

C: offset is produced at 200° C.

D: offset is produced at 190° C.

Streaking (Developing Performance)

Operating in a high-temperature, high-humidity environment (temperature 32° C./humidity 80% RH), a 50000-print print-out test was performed using a horizontal line image having a print percentage of 1%. After the completion of this test, a halftone (toner laid-on level: 0.3 $mg/cm^2$) image was printed out on letter-size XEROX 4200 paper (75 $g/m^2$, Xerox Corporation), and the presence/absence of vertical streaks in the halftone image in the paper discharge direction was scored and the durability was evaluated as follows.

Evaluation Criteria

A: no production

B: vertical streaks in the paper discharge direction are produced at from 1 to 3 locations in the halftone image C: vertical streaks in the paper discharge direction are produced at from 4 to 6 locations in the halftone image D: vertical streaks in the paper discharge direction are produced at 7 or more locations in the halftone image, or a vertical streak with a width of 0.5 mm or more is produced Examples 1 to 10

The evaluations given above were performed in Examples 1 to 10 using each of toners 1 to 10 for the toner. The results of the evaluations are given in Table 4.

Comparative Examples 1 to 6

The evaluations given above were performed in Comparative Examples 1 to 6 using each of toners 11 to 16 for the toner. The results of the evaluations are given in Table 4.

TABLE 4

| | | offset | gloss | streaking (developing performance) |
|---|---|---|---|---|
| Example 1 | toner 1 | A | A (40) | A |
| Example 2 | toner 2 | A | A (40) | A |
| Example 3 | toner 3 | A | A (35) | A |
| Example 4 | toner 4 | A | A (30) | A |
| Example 5 | toner 5 | A | A (35) | A |
| Example 6 | toner 6 | A | B (25) | B |
| Example 7 | toner 7 | B | B (20) | A |
| Example 8 | toner 8 | A | A (30) | A |
| Example 9 | toner 9 | A | B (20) | A |
| Example 10 | toner 10 | A | A (30) | C |
| Comparative Example 1 | toner 11 | C | D (5) | A |
| Comparative Example 2 | toner 12 | C | D (10) | A |
| Comparative Example 3 | toner 13 | C | D (10) | A |
| Comparative Example 4 | toner 14 | C | D (10) | A |
| Comparative Example 5 | toner 15 | D | A (30) | D |
| Comparative Example 6 | toner 16 | B | B (25) | D |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-204456, filed Oct. 30, 2018, which is hereby incorporated by reference herein in its entirety.

What is claimed is:

1. A toner, comprising:

a toner particle that contains a hinder resin, the binder resin containing a styrene-acrylic resin having a structure formed by copolymerizing a crosslinking agent with polymerizable monomers that form the styrene-acrylic resin;

the crosslinking agent containing a polymeric compound provided by an addition reaction between at least a compound represented by formula (1) and a compound represented by formula (2)

(1)

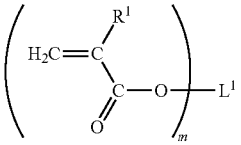

(2)

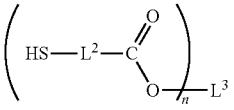

where $R^1$ represents a hydrogen atom or an alkyl group having 1 to 4 carbon atoms; $L^1$ represents an m-valent linear or branched aliphatic hydrocarbon group optionally having a hydroxy group, or an ether bond-containing m-valent linear or branched aliphatic hydrocarbon group optionally having a hydroxy group; m is an integer from 3 to 6; $L^2$ represents an alkylene group; $L^3$ represents an n-valent linear or branched aliphatic hydrocarbon group optionally having a hydroxy group, or an ether bond-containing n-valent linear or branched aliphatic hydrocarbon group optionally having a hydroxy group; and n is an integer from 3 to 6, wherein the binder resin includes tetrahydrofuran-insoluble matter in an amount of 5 to 60 mass % of the binder resin.

2. The toner according to claim 1, wherein the crosslinking agent has a weight-average molecular weight of 4,000 to 50,000.

3. The toner according to claim 1, wherein the crosslinking agent includes a total of at least 10 acryloyl groups and methacryloyl groups per molecule.

4. The toner according to claim 1, wherein the polymeric compound is a dendritic acrylate or a dendritic methacrylate.

5. The toner according to claim 1, wherein the crosslinking agent further comprises a compound represented by formula (3)

(3)

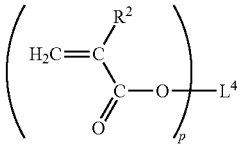

where $R^2$ represents a hydrogen atom or an alkyl group having 1 to 4 carbon atoms; $L^4$ represents a p-valent linear or branched aliphatic hydrocarbon group optionally having a hydroxy group, or an ether bond-containing p-valent linear or branched aliphatic hydrocarbon group optionally having a hydroxy group; and p is an integer from 2 to 6.

6. A method for producing the toner according to claim 1, the method comprising:

dispersing and granulating in an aqueous medium a polymerizable monomer composition comprising the crosslinking agent and the polymerizable monomers that form the styrene-acrylic resin to form particles of the polymerizable monomer composition; and obtaining toner particles by copolymerizing the crosslinking agent with the polymerizable monomers, the crosslinking agent and the polymerizable monomers that are contained in the particles of the polymerizable monomer composition.

* * * * *